United States Patent [19]

McLeod

[11] Patent Number: 4,991,650

[45] Date of Patent: Feb. 12, 1991

[54] WELLHEAD ISOLATION TOOL

[76] Inventor: Roderick D. McLeod, 5104-125 Street, Edmonton, Alberta, Canada, T6H 3V5

[21] Appl. No.: 443,389

[22] Filed: Nov. 30, 1989

[30] Foreign Application Priority Data

Dec. 1, 1988 [CA] Canada ..... 584720

[51] Int. Cl.[5] ..... E21B 23/06; E21B 33/02

[52] U.S. Cl. ..... 166/72; 166/77; 166/80; 166/196

[58] Field of Search ..... 166/70, 72, 73, 80, 166/85, 90, 77, 75.1, 196, 179, 192; 73/49.6, 49.5, 40.5 R, 46, 49.1

[56] References Cited

U.S. PATENT DOCUMENTS

| | | | |
|---|---|---|---|
| 2,056,543 | 10/1936 | Tschappat | 166/80 |
| 3,366,181 | 1/1968 | McCall | 166/72 |
| 3,830,304 | 8/1974 | Cummins | 166/80 X |
| 4,023,814 | 5/1977 | Pitts | 166/90 X |
| 4,241,786 | 12/1980 | Bullen | 166/77 |
| 4,452,304 | 5/1984 | Barrier et al. | 166/70 |
| 4,632,183 | 12/1986 | McLeod | 166/77 |
| 4,657,075 | 4/1987 | McLeod | 166/72 |
| 4,691,770 | 9/1987 | McLeod | 166/73 |
| 4,867,243 | 9/1989 | Garner et al. | 166/77 X |

FOREIGN PATENT DOCUMENTS

| | | |
|---|---|---|
| 357963 | 5/1936 | Canada . |
| 1217128 | 1/1987 | Canada . |

*Primary Examiner*—Hoang C. Dang

*Attorney, Agent, or Firm*—Stevens, Davis, Miller & Mosher

[57] ABSTRACT

An improved wellhead isolation tool is presented which includes an expanding nipple operable from outside the wellhead and casing, the nipple and its concentric mandrels being inserted into the wellhead and thus down through the wellhead array and into the casing or tubing by a concentric hydraulic cylinder. The nipple is then expanded and sealed in the casing or tubing by a second concentric hydraulic cylinder. It is then locked in place both mechanically and hydraulically.

3 Claims, 3 Drawing Sheets

WELLHEAD ISOLATION TOOL

FIELD OF THE INVENTION

This invention relates to wellhead isolation tools and in particular to the improvement of a tool presently using a mandrel inserted by hydraulic action on an attached concentric piston in a concentric and surrounding hydraulic cylinder. The addition of an expanding nipple utilizing a concentric mandrel and hydraulic control is proposed.

BACKGROUND OF THE INVENTION

In oilfield service work, a piece of equipment referred to in the trade as a "tree saver" or wellhead isolation tool is often used. This apparatus generally introduces a high pressure hollow mandrel with a sealing nipple through the low pressure rated valves and fittings on a wellhead and the resilient sealing material on the nipple at the lower end of the mandrel seals the mandrel in the well casing or tubing. This allows high pressure fluids to be introduced into the well casing or tubing through the mandrel without their having any communication with these low pressure valves and fittings. For the remainder of this application, the word casing will be used for casing and tubing. There is an existing wellhead isolation tool designed and manufactured by McEvoy circa 1955 which is still utilized in well servicing with good results considering the changes in well servicing technology since its inception. However, problems with the sealing of the nipples in large diameter casing due to the diametral tolerances in these casings have been prevalent. The upgrading of this particular apparatus with the concentric mandrel and expanding nipple system described in both my Canadian Pat. No. 1,217,128 issued Jan. 27, 1987 and my U.S. Pat. No. 4,657,075, issued Apr. 14, 1987 is proposed.

SUMMARY OF THE INVENTION

According to a broad aspect, the invention relates to a novel apparatus and method to improve the operation of an existing concentric mandrel wellhead isolation tool. The apparatus comprises a nipple with a molded expandable resilient material on its periphery, this nipple connected to the existing mandrel; an expander for expanding this material, a high pressure hollow inner mandrel connected to this expander with means at the opposite end for moving and locking this inner mandrel in place in respect to the mandrel of the existing wellhead isolation tool and means to attach a valve to this inner mandrel.

According to a broad aspect the invention relates to a concentric mandrel apparatus for use as a wellhead isolation tool, said apparatus comprising (a) means for mounting said apparatus on a wellhead; (b) an inner mandrel extending down through and acted on by an actuating cylinder and extending through an outer mandrel and having a seal expander on the lower end of said inner mandrel; (c) an outer mandrel extending down through and acted on by an operating cylinder and having a nipple means including a resilient sealing member attached to the lower end thereof; the improvement in said apparatus comprises:

means in the actuating cylinder for moving the inner mandrel relative to the outer mandrel so that its seal expander will deform the resilient sealing member of the outer mandrel against the casing;

means for mechanically locking the inner mandrel in position in relation to the outer mandrel;

means in the actuating cylinder for hydraulically locking the inner mandrel in position in relation to the outer mandrel; and piston means in the operating cylinder to move the assembly of inner mandrel, actuating cylinder and outer mandrel relative to the wellhead in order to position the resilient sealing member in a well casing.

BRIEF DESCRIPTION OF THE DRAWINGS

The invention is illustrated by way of example only in the accompanying drawings in which.

DESCRIPTION OF THE EXISTING EMBODIMENT

Figure 1:
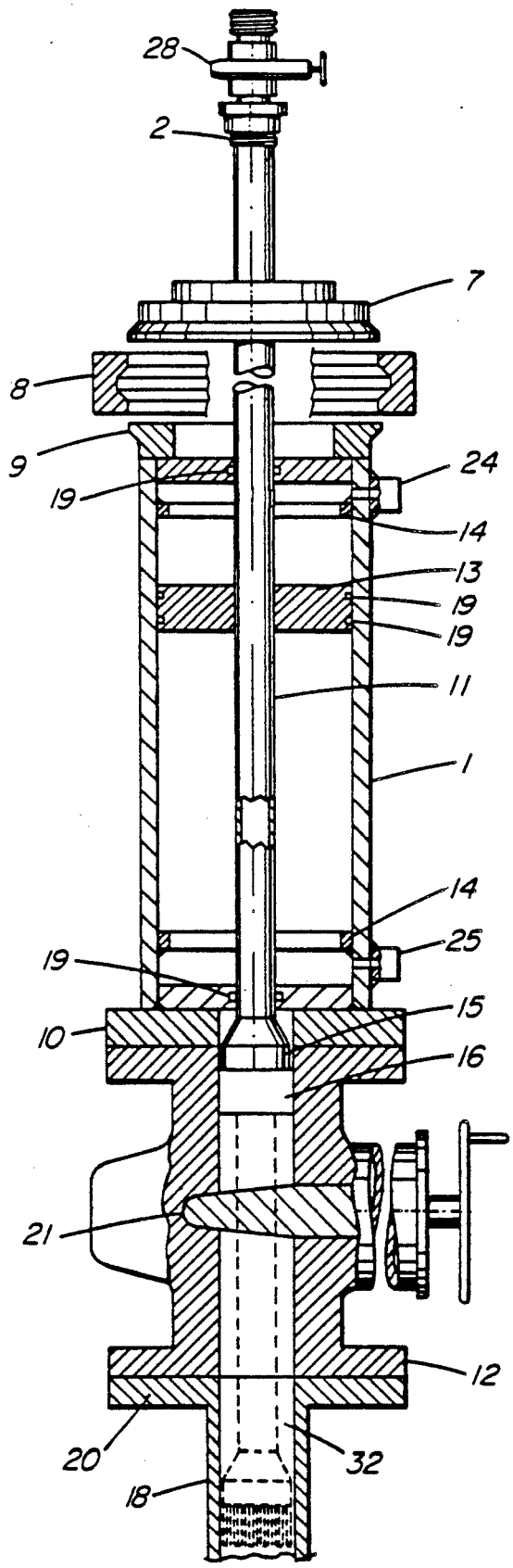
FIG. 1 is an elevation view, partly in section, of the existing wellhead isolation tool in position prior to being moved into the wellhead valve and down into the well.

Referring to FIG. 1, the tool illustrated generally is mounted to a simple wellhead valve for clarity of description and includes a hollow concentric mandrel 11, a plug valve 28 connected at what will be called the upper end of the mandrel at 2, an attached lockdown flange 7, a piston 13 affixed to the mandrel and a sealing nipple 15 with its molded resilient material 16 affixed at the lower end of the mandrel, this resilient material being of a diameter to cause a compression fit in the casing 18. The mandrel 11 and piston 13 are enclosed in a concentric operating cylinder 1 in a vertically moving way but limited in travel by spaced upper and lower stop rings 14. The concentric operating cylinder 1 also comprises fluid inlet and outlet ports 25 and 24, an attached wellhead adapter 10, an attached lockdown ring 9 and locking clamp 8 and upper and lower seals 19. The wellhead valve 12 and its gate 21 and the well casing 18 and wellhead flange 20 are not a part of the tool.

Figure 2:
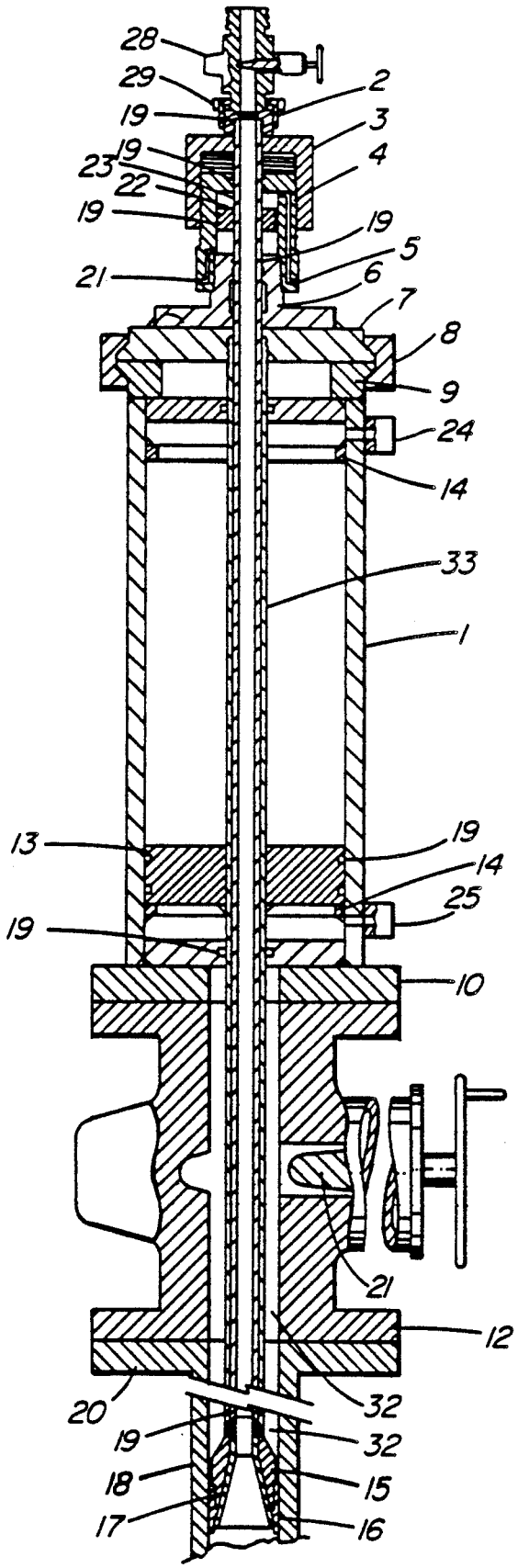
FIG. 2 is an elevation view, in full section, of the proposed wellhead isolation tool with the invented inner mandrel, expander, expanding nipple, actuating means and locking means shown. The concentric mandrels of the tool have been moved into the well and are in the operating position with the nipple expanded.

In operation, the plug valve 28 is in the closed position, and the wellhead valve 21 gate will be opened (as shown in FIG. 2). Hydraulic fluid from an outside source is pumped into the port 24, the port 25 being opened. The piston 13 and thus the mandrel 11 and its associated fittings are caused to move in a downward direction, moving the lower end and the sealing nipple 16 through the wellhead valve 12 and into the well casing 18. When the sealing nipple 15 is in place, as shown by the broken lines, the lockdown flange 7 will be adjacent to the lockdown ring 9 and these will be locked together with the locking clamps. The tool is now in the operational position forming the annular space 32 between the lower end of the mandrel 11 and wellhead valve interior.

Appropriate piping is attached to the top of the plug valve 28 and this valve will be opened to allow fluids and materials to be pumped down through the mandrel and into the casing 18 with no communication of the pumped materials to the wellhead valve 12. It is obvious that the maximum diameter of the resilient sealing material 16 is governed by the inside diameter of the wellhead valve 12. In large diameter casings, manufacturing variations, corrosion and erosion of the casing leave larger and more irregular inside diameters than the sealing material can accommodate. This causes failure of the seal.

To remove the tool from the well, the reverse procedure to installing it is followed.

DESCRIPTION OF THE PREFERRED EMBODIMENT

Referring to FIG. 2, the tool illustrated generally is mounted to a simple wellhead valve for clarity of description and includes the following; an inner mandrel 23 which is held slidingly inside an outer mandrel 33, which inner mandrel 23 has attached at its lower end a nipple expander 17, at the upper end an affixed piston 22 and a connection means 2 for the plug valve 28. The outer mandrel 33 has affixed at its lower end a sealing nipple 15 with its molded resilient material 16 and terminates at its upper end in a fixed way in the lockdown flange 7. To this lockdown flange is attached a packing gland 6 through which the inner mandrel moves in a sliding way, and to which packing gland is attached an actuating cylinder 4 with its fluid ports 5 and 21, and in which actuating cylinder the piston 22 moves in a sealed way. On the periphery of this actuating cylinder 4 a locknut 3 is threadingly held and which butts against the shoulder formed by the connection means 2 of the inner mandrel 23. Affixed to the outer mandrel 33 is an outer mandrel piston 13 which moves slidingly in a sealed way inside the operating cylinder 1, and is restrained from travel at either end by the spaced upper and lower stop rings 14. This operating cylinder comprises fluid ports 24 and 25, the attached lockdown ring 9, the locking clamp 8 and the attached wellhead adapter 10. Various seals in the assembly are shown as 19. The wellhead valve 12, its gate 21, the wellhead flange 20 and the casing 18 are not part of the tool assembly. Annular space 32 is formed by the outer mandrel inside the casing and wellhead valve. The tool is shown in the operating position, ready to have fluids pumped through it into the well casing.

The actions to put the outer mandrel 33, its inner mandrel 23, nipple expander 17 and attached devices into the well casing 18 through the wellhead valve are as follows: (a) With the tool in place on the wellhead valve 12, and the plug valve 28 closed, the wellhead valve gate 21 is opened. Hydraulic means pump fluid to the port 24 of the operating cylinder 1 and the action on the outer mandrel piston 13 moves this piston and thus the outer mandrel 33, its sealing nipple 15 and the attached and internal devices in a downward direction through the wellhead valve 12 and into the casing 18. When the lower stop ring 14 is reached, the locking clamp 8 is locked around the lock ring 9 and the lockdown flange 7. The sealing nipple 15 and rest of the assembly will be in the working position shown in FIGS. 2 and 3*a*.

Figure 3B:
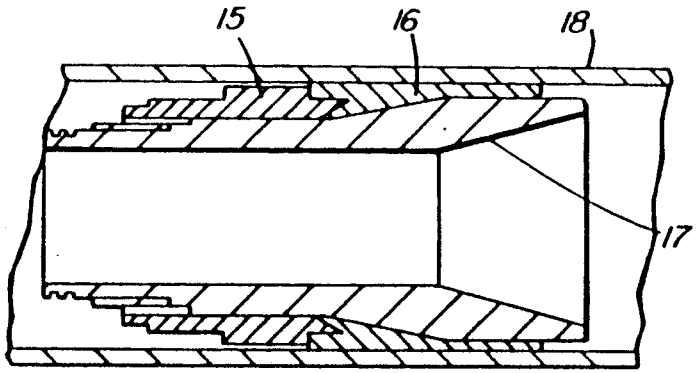
FIGS. 3*a* and 3*b* are cross sectional views of a sealing nipple, its resilient material and a nipple expander in the expanded position.
Figure 3A:
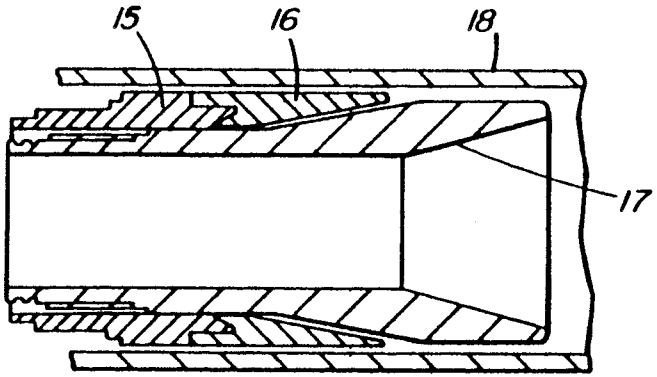

Now hydraulic means are used to pump fluid into the port 21 in the actuating cylinder 4. This causes the inner mandrel piston 22 and mandrel 23 to move upwards with respect to the outer mandrel 33, thus causing the nipple expander 17 at the lower end of the inner mandrel 23 to move into the resilient material 16 and effect a circumferential seal between the nipple expander 17, sealing nipple 15 and the casing 18. This is shown in FIG. 3*b*.

Figure 4:
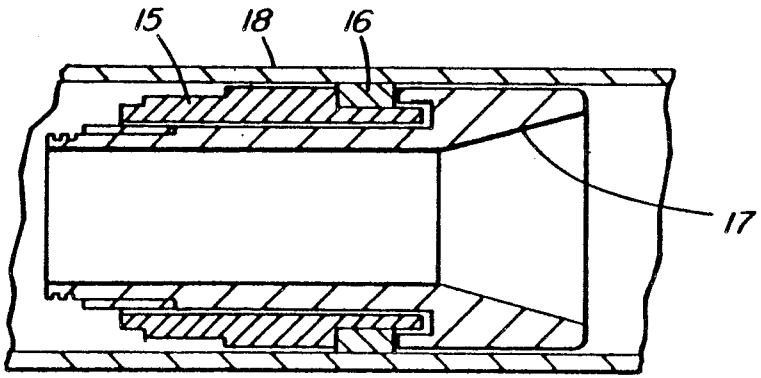
FIG. 4 is a cross section view of an alternate sealing nipple and nipple expander.

A second type of nipple 15, nipple expander 17 and sealing resilient material 16 is shown in FIG. 4 by way of example as to the different types of seal that can be effected with the moveable internal-external mandrel system.

The locknut 3 is now rotated in a direction which will butt it up against the inner mandrel connection means 2. This will mechanically lock the inner mandrel 23 and thus the nipple expander 17 in respect to the outer mandrel 33 and hold the resilient sealing material 16 in the sealed position of FIG. 3*b*. The ports 21 and 5 will also be sealed to hydraulically lock the inner mandrel 23 in this position. The cavity 32 is now isolated from the fluids and material to be pumped through the inner mandrel 23 and the casing 18, thus protecting any fittings above the sealing nipple 15 from the well servicing fluids. To remove the tool from the wellhead valve 12, the locknut 3 is first rotated in a direction to move it away from the inner mandrel connection means 2. The ports 21 and 5 are opened and hydraulic means used to pump fluid to port 5. This fluid acts on the inner mandrel piston 22 and moves it in a downward way in respect to the outer mandrel 33, thus disengaging the nipple expander 17 from the sealing nipple 15 and its resilient material 16. This material is no longer compressed against the casing. The locking clamp 8 is now taken off and fluid pumped to the port 25. The outer mandrel piston 13 moves in an upward direction, moving the outer mandrel 33, its sealing nipple and attached internal and external devices, out of the well casing and the wellhead valve. When the sealing nipple 15 has moved past the wellhead valve gate 21, the gate is closed and the tree saver may now be taken off of the wellhead.

During the insertion and removal operations, pressure from the well will cause different actions on the tool, and this pressure may have to be equalized across the sealing rubber and may have to be countered by restricting fluid flow from the cylinder ports. These are common operational practices and are not claimed in this application.

Those skilled in the art will appreciate that various features, characteristics and advantages of the present invention have been set forth herein or are readily realizable from the detailed description of the preferred embodiments. However, the disclosure is illustrative and various changes may be made while utilizing the principles of the present invention and falling within the scope of the invention as expressed in the appended claims.

The embodiments of the invention in which an exclusive property or privilege is claimed are defined as follows

1. A concentric mandrel apparatus for use as a wellhead isolation tool, said apparatus comprising:

(a) means for mounting said apparatus on a wellhead;

(b) an inner mandrel extending down through and acted on by an actuating cylinder and extending through an outer mandrel and having a seal expander on the lower end of said inner mandrel;

(c) an outer mandrel extending down through and acted on by an operating cylinder and having a nipple means including a resilient sealing member attached to the lower end thereof; the improvement in said apparatus comprises:

means in the actuating cylinder for moving the inner mandrel relative to the outer mandrel so that its seal expander will deform the resilient sealing member of the outer mandrel against the casing;

means for mechanically locking the inner mandrel in position in relation to the outer mandrel;

means in the actuating cylinder for hydraulically locking the inner mandrel in position in relation to the outer mandrel; and piston means in the operating cylinder to move the assembly of inner mandrel, actuating cylinder and outer mandrel relative to the wellhead in order to position the resilient sealing member in a well casing.

2. A wellhead isolation tool having expandable nipple means for insertion through a wellhead array into a well casing and operable from outside of said wellhead and casing and including means for expanding said nipple means in said casing and for releasably locking said nipple means in place in said casing; said tool comprising a first, outer, fluid operated cylinder mounted on said wellhead, a first, outer mandrel concentrically located in said first cylinder and having its lower end extending downwardly into said casing, said expandable nipple means being secured to the lower end of said outer mandrel, piston means in said first cylinder and secured to said first, outer mandrel for moving said outer mandrel and its expandable nipple means relative to the wellhead and into and out of said casing responsive to fluid action on said piston means, gland and flange means secured to the upper end of said first, outer mandrel for locking said outer mandrel and said expandable nipple means in position relative to said first cylinder and said casing;

a second, inner mandrel concentrically located and slidable within said first, outer mandrel, means on the lower end of said second, inner mandrel for circumferentially expanding said nipple means in said casing to seal off said casing from the wellhead;

a second, fluid operated cylinder secured to the upper end of said first cylinder, the upper end of said inner mandrel being located in said second cylinder, piston means in said second cylinder and secured to said inner mandrel upper end whereby fluid pressure on either side of said piston vertically moves said inner mandrel within said outer mandrel; and means for locking the inner mandrel in position relative to said outer mandrel.

3. Apparatus according to claim 2 wherein said expandable nipple means comprises a rigid cylindrical member detachably secured to the lower end of said first, outer mandrel and a skirt portion of resilient material moulded onto the lower end of the cylindrical member, said skirt portion having a cylindrical outer wall and a frusto-conical inner wall; and wherein said means for circumferentially expanding said nipple means comprises a rigid, tubular member detachably secured to the lower end of said inner mandrel, said tubular member having a cylindrical outer wall portion and an adjacent frusto-conical portion generally in juxtaposition to that of said resilient material whereby, when said inner mandrel is raised relative to said outer mandrel, said frusto-conical portion on the inner mandrel engages and radially expands said resilient material to seal the same against the inner wall of said casing.

* * * * *